US005171076A

United States Patent [19]

Eming

[11] Patent Number: 5,171,076

[45] Date of Patent: Dec. 15, 1992

[54] HEAT INSULATING COVERING FOR COOLING SHELF UNITS

[75] Inventor: Winfried Eming, Rheinbreitbach, Fed. Rep. of Germany

[73] Assignee: Geta Gesellschaft Für Energietechnik und-Anwendung mbH, Bad Honnef, Fed. Rep. of Germany

[21] Appl. No.: 766,456

[22] Filed: Sep. 26, 1991

[30] Foreign Application Priority Data

Oct. 3, 1990 [DE] Fed. Rep. of Germany ... 9013749[U]

[51] Int. Cl.[5] ..... A47F 3/04; E04F 10/06

[52] U.S. Cl. ..... 312/116; 312/297; 160/66

[58] Field of Search ..... 160/120, 242, 67, 68, 160/66; 312/116, 297

[56] References Cited

U.S. PATENT DOCUMENTS

| | | | |
|---|---|---|---|
| 317,238 | 5/1885 | Stedman | 160/67 |
| 4,077,719 | 3/1978 | Lux | 160/68 X |
| 4,424,685 | 1/1984 | Ibrahim | 312/116 X |
| 4,733,683 | 3/1988 | Pozzi | 160/68 X |
| 4,923,258 | 5/1990 | Styles | 312/116 X |

*Primary Examiner*—Peter R. Brown
*Attorney, Agent, or Firm*—Michael J. Striker

[57] ABSTRACT

A heat insulating covering is provided for a cooling shelf unit having a lower goods member, a plurality of intermediate shelf members vertically spaced from the lower goods member and from one another, and an upper cover part. The covering has a blind web adapted to cover a cooling space of the cooling shelf unit between a front edge of the cover part and a parallel front edge of the goods member over a whole horizontal length of the cooling shelf unit, a shade axle adapted to extend over the whole horizontal length of the cooling shelf unit, a lower stabilizing rail, a drive motor connected with the blind axle of the blind web and operative both in a closing direction and in an opening direction of the blind web, spring biased turning arms supporting the stabilizing rail of the blind web and having hinges located between the shade axle and the parallel front edge of the goods member. The turning arms during rolling off of the blind web from the shade axle to the front edge of the goods member guide the stabilizing rail with the blind web downwardly and holding the blind web under tension.

17 Claims, 4 Drawing Sheets

HEAT INSULATING COVERING FOR COOLING SHELF UNITS

BACKGROUND OF THE INVENTION

The present invention relates to a heat insulating covering for cooling shelf units in sales places and the like.

Cooling shelf units are open toward sales spaces and are provided with a lower goods member or bottom, a rear wall at its rear side, a plurality of stationary or adjustable shelf members spaced in vertical direction one above the other and above the goods member, and a top part. Such cooling shelf units are very convenient for goods presentation and have been used in increasing variety. However, they have the disadvantage that due to their geometry it is not possible to arrange on them motor driven so-called post-blinds. Conventional hand-operated snapping blinds are used for such cooling shelf units in order to at least partially hold within the limits the high cooling looses in the forwardly open cooling shelf units, at least during the night hours or weekends or in other words after the sales time. Such snapping blinds are conventionally not wider than 120–150 cm, for their easy handling. Therefore, for the shelf length of such cooling shelf units which conventionally have the individual length of 5–6 m and can be assembled to several neighboring units with total length of 40–50 m, the expenses for manual actuation of the required many snapping blinds is very high. It is also an important disadvantage that with such many hand-operated snapping blinds the operational condition "blind close" can not be attained in a reliable manner for an energy-saving regulating process which includes turning the cooling aggregates to night operation and switching off the shelf illumination. In the cooling shelf devices in which during the operation the cooling aggregate is to be controlled over the time, it can happen that the individual hand-operated blinds are not reliably closed. As a result, the cooling intensity reduced with the not completely closed blinds during the night operation is not sufficient to reliably cool the goods. Also, it does not make sense to provide end switches for the operational condition "blind closed" for such hand-operated blinds, when one takes into consideration that for the shelf length 50 m at least 30 or more snapping blinds with a corresponding great number of end switches is required. Moreover, there are difficulties in utilization of conventional motor-operated blinds, since they can be driven to the closing position only by their own weight and conventionally only opened with the assistance of a motor.

SUMMARY OF THE INVENTION

Accordingly, it is an object of the present invention to provide a heat insulating covering for cooling shelf units, which avoids the disadvantages of the prior art.

More particularly, it is an object of the present invention to provide a heat insulating covering for cooling shelf units, especially to be used in sales places and the like, which is formed so that a motor operation for the covering without affecting the goods presentation and the individual cooling shelves is possible, on the one hand, and also an end switch can be used to reliably indicate the operational condition "blind closed" in an efficient manner.

In keeping with these objects and with others which will become apparent hereinafter, one feature of the present invention resides, briefly stated, in a heat insulating covering in which a blind axle of a blind web is connected with a drive motor operative both in a closing direction and in an opening direction, and a stabilizing rail of the blind web is held on spring-biased turning arms which are arranged on hinges located between the blind axle and a parallel front edge of a lower goods member, so that the stabilizing rail with the blind web during rolling off from the blind axle to the front edge of the lower goods member is guided downwardly and held under tension.

When the covering is designed in accordance with the present invention, commercial sun blinds can be used for the heat-insulating covering. In addition to the objective of the air guiding and heat insulating, they can have end switch devices which for example turn off the shelf illumination and moreover lower the cooling intensity for night and weekend periods.

With such heat insulating coverings which include a blind web spanning the space of the cooling shelf unit between the front edge of the upper cover part and the parallel front edge of the lower goods member over the whole horizontal length, and also a drive motor operative both in a closing direction and in an opening direction as well as an end switch for controlling the complete closing position of the covering and interrupting the current supply to the drive motor when the closing position of the blind web is reached, the covering can be easily adapted for cooling shelf units having conventionally the length of 5–6 meters as utilized in big cooling shelf devices in supermarkets. The end switch can be selectively associated with the blind or integrated in the motor.

In accordance with the further feature of the present invention, the turning arms engage both ends of the stabilizing rail and are arranged on two hinges provided at both ends of the cooling shelf unit, so that they can be turned away of the goods member outwardly about an axis extending parallel to the front edge of the goods member so that the blind web with the stabilizing rail moves downwardly over a circular arc from the upper cover part to the front end of the lower goods member without contacting the goods stacked in the cooling shelves. This construction has the advantage that the whole cooling space of each cooling shelf unit above the front edge of the lower goods member can be used for stacking of the goods, without affecting the covering during the night or weekends by lowering the blind web. After the contact-free lowering by the turning arms, the blind web is smoothly stretched between the front edge of the upper cover part and the front edge of the lower goods member.

A further very practical embodiment of the heat insulating covering is embedded in a construction in which the turning arms are formed as two-leg hinge arms which are turnably supported on the front edge of the cover part on a supporting pipe so as to turn from the blind axle, and therefore the blind web with the stabilizing rail can be guided rectilinearly downwardly into the plane between the front edge of the cover part and the front edge of the goods member. In this embodiment the blind web under the action of the two-leg hinge arms which are spring-biased, also can be moved without additional guiding devices in a simple manner to the front edge of the lower goods member and held under tension.

It is especially advantageous when the drive motor for the blind web is integrated in the blind axle. For controlling the complete closing position of the blind web it is possible to provide an end switch in all embodiments. The end switch interrupts the current supply of the drive motor when the closing position of the blind web is reached. Moreover, also an end switch can be provided for the movedin position of the covering. The end switches can be mechanically, optical or magnetic.

The blind axle of the blind web can be arranged on supporting profiles which are supported on the cover part of the cooling shelf unit so that they are horizontally displaceable transverse to the longitudinal direction. The supporting profiles can move from the cover part forwardly so far that the blind web assumes a substantially vertical position over the front edge of the goods member for vertical rolling off to the front edge of the goods member.

The supporting profiles for the blind axle can be formed as toothed racks which engage toothed wheels of a motor-driven toothed rack drive.

Finally, the intermediate space between the supporting profiles can be closed over the entire horizontal length of the cooling shelf unit by a fabric element or a metal sheet element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
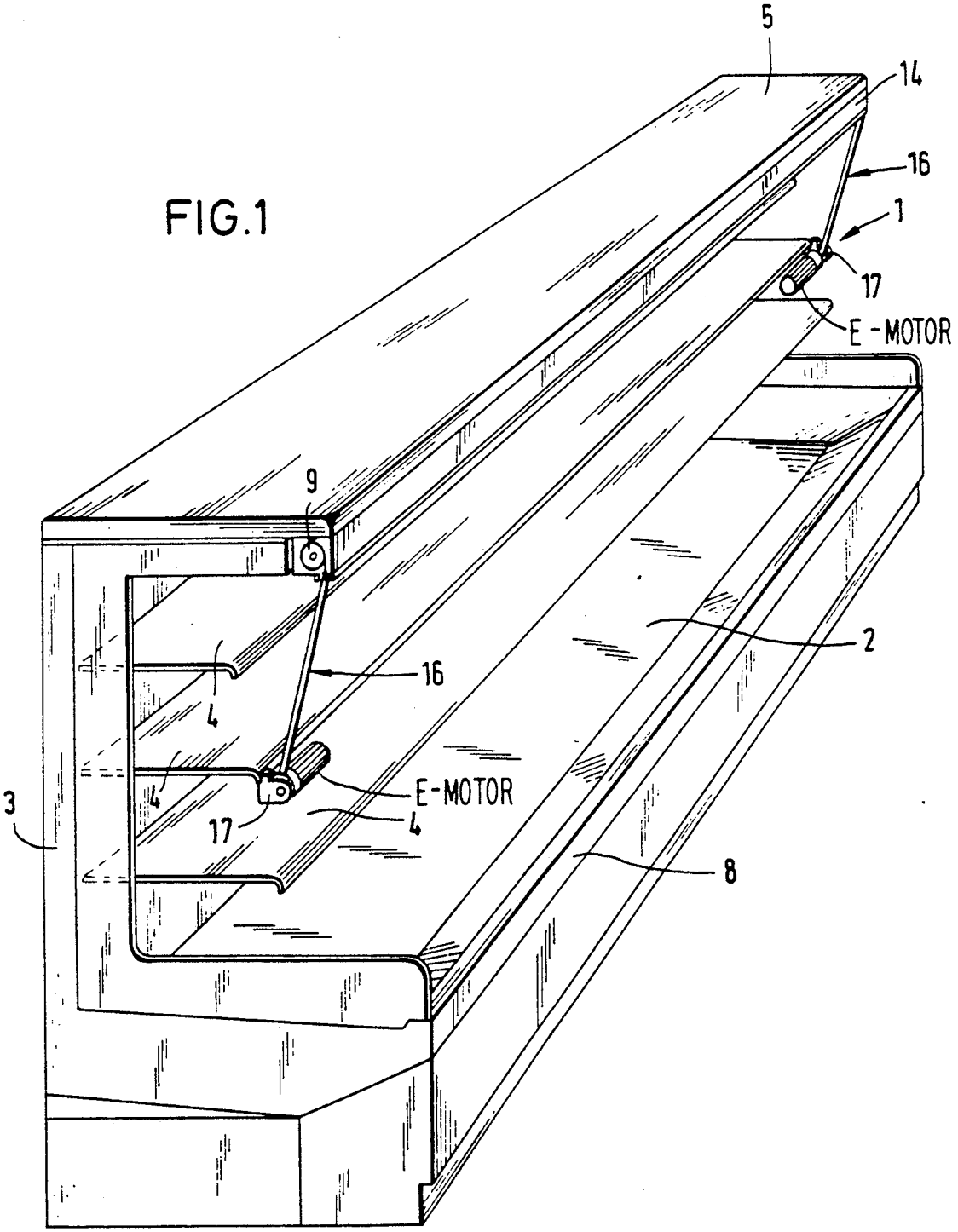
FIG. 1 is a perspective view of a cooling shelf unit with a motor-driven blind web extending over the whole length at a front edge of an upper cover part of the unit.

Cooling shelves shown in the drawings are formed as a conventional cooling shelf unit 1 with a length of approximately 5–6 m. Such cooling shelf units are used particularly in sales spaces and the like. The cooling shelf unit 1 has a lower goods member 2, a rear wall 3 arranged at its rear side, and several shelf members 4 which are arranged one over the other stationarily or adjustably. The shelf members 4 are covered or closed from above approximately at the height of sight of a buyer by an upper cover part 5 which springs back relative to the lower goods member 2. The cover part 5 has a setting surface for presentation of goods.

As can be seen further from the drawings, each cooling shelf unit 1 has a front covering for a cooling chamber 6. The covering is formed by a blind web 9 which covers the cooling space 6 between a front edge 7 of the cover part 5 and a parallel front edge 8 of the goods member 2 through its total horizontal length. The blind web 9 has a drive motor. It is also provided with an end switch 10 for controlling the complete closing position of the covering, in other words, the operational condition "blind closed". The end switch 10 interrupts the current supply to the drive motor when the closing position of the blind web 9 is reached. The current supply can be selectively interrupted also by an end switch which is integrated in the drive motor.

In all shown embodiments the drive motor which is operative both in the closing direction and in the opening direction for the blind web 9 is integrated in a shade axle 11.

In the first embodiment of a heat insulating covering for cooling shelves in accordance with the present invention, the blind web 9 with the shade axle 11 is arranged on supporting profiles 12. The supporting profiles 12 are horizontally displaceably mounted on the cover part 5 of the cooling shelf unit 1 transversely to its longitudinal extension. They can move forwardly from the cover part 5 so far until the shade web 9 assumes a substantially vertical position over the front edge 8 of the goods member 2 for vertical rolling out until an end position at the front edge to the goods member 2. The supporting profiles 12 for the motor-driven blind web 9 run on guiding rollers 12a and are formed as toothed racks for the engagement with toothed gears 13 of a motor-driven toothed rack drive.

The shade arrangement is mounted with a box-shaped aperture 14 from below on the movable supporting profiles 12 or toothed racks. The intermediate space between the supporting profiles 12 is closed over the whole length of the cooling shelf unit 1 by cloth or sheet. The blind web 9 has a stabilizing rail 15 which extends at its lower edge over the whole width of the shade and tensions the blind web 9. The stabilizing rail 15 can be arranged on a turning arm 16 shown in FIGS. 4 and 5 or on a pivot arm shown in FIGS. 6 and 7.

Figure 2:
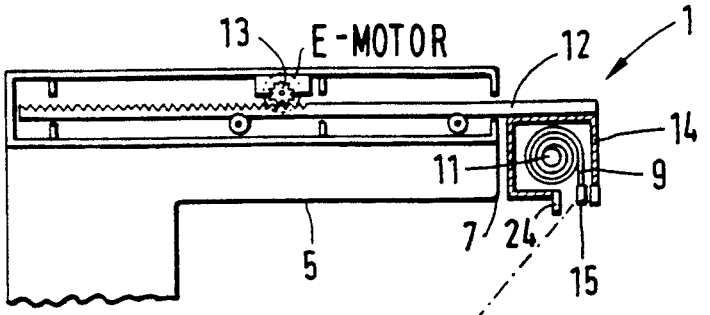
FIG. 2 is a partially sectioned end view showing bringing of the motor-driven blind web on the cooling shelf unit to the operational condition "blind open"

As can be seen from FIGS. 1 and 2, the blind web 9 in the operational position "blind open" is located on the front edge 7 of the cover part 5 which overlaps the individual shelf members 4. For example, by a time control it can be moved the supporting profiles 12 from the cover part 5 so far forwardly in a horizontal direction that it is located perpendicularly above the front edge 8 of the lower goods member 2 of the cooling shelf unit 1. The drive motor for the blind web 9 is set in operation so that the blind web 9 with the lower stabilizing rail 15 is rolled downwardly so far that the stabilizing rail 15 is brought in contact with the end switch 10 arranged on the front edge 8 of the lower goods member 2. The end switch 10 can be formed as a mechanical, optical or magnetic end switch. As a result, the motor drive is stopped, and moreover, a control signal is sent to the cooling aggregate of the cooling shelf device for switching over to night or weekend operation.

Figure 3:
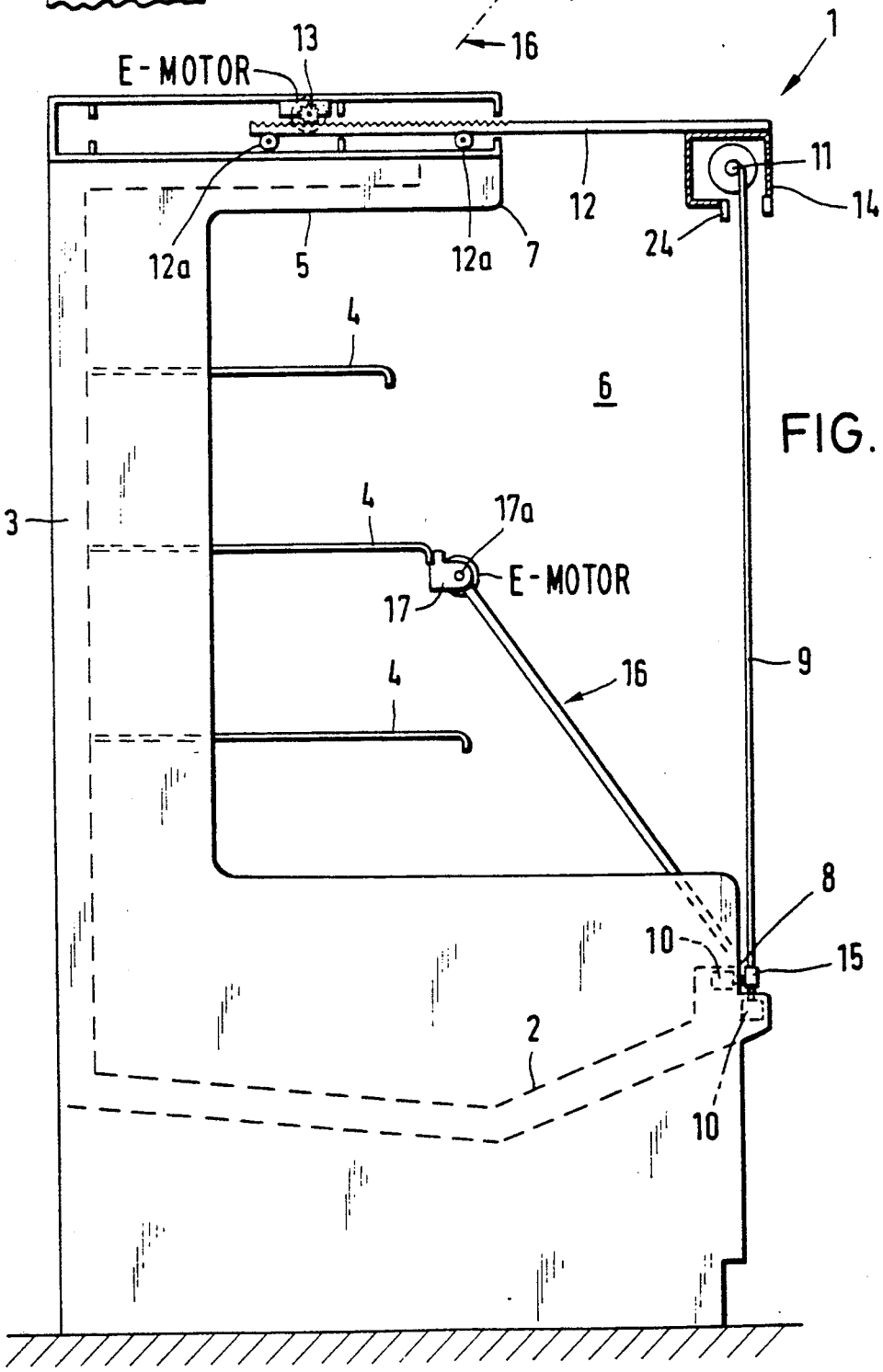
FIG. 3 is a view substantially corresponding to the view of FIG. 2 and showing the operational position "blind closed"
Figure 4:
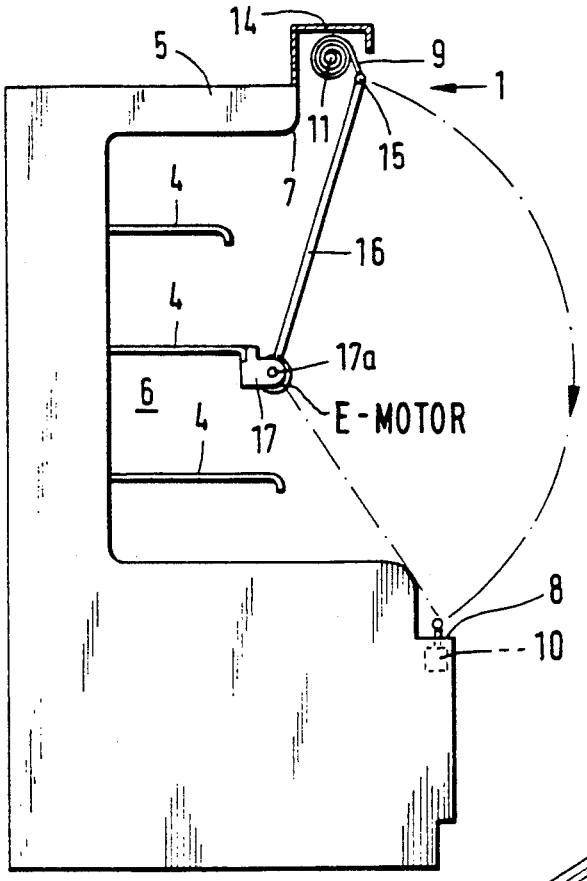
FIG. 4 is an end view substantially corresponding to the views of FIGS. 2 and 3 for the embodiment with turning arms for the motor-driven blind web in the operational condition "blind"
Figure 5:
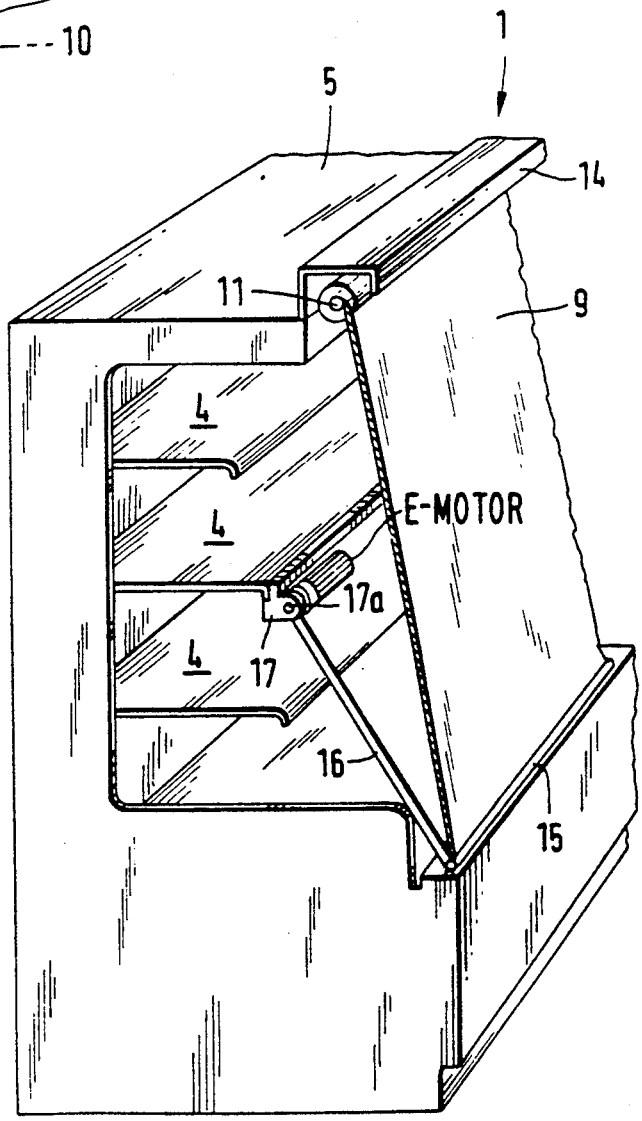
FIG. 5 is a perspective partial view of the embodiment of FIG. 4 in the operational condition "blind closed"

Instead of the embodiment shown in FIGS. 1-3 with suspending the shade axle 11 of the blind web 9 on the supporting profiles 12 movable forwardly from the cover part 5 of the cooling shelf unit 1, the heat insulating covering for such cooling shelves can be formed as shown in the embodiment of FIGS. 4 and 5. Here the blind web 9 with the shade axle 11 extending over the whole horizontal length of the cooling shelf unit 1 and the lower stabilizing rail 15 is supported on the front edge 7 of the cover part 5. Two turning arms 16 engage both ends of the stabilizing rail 15. The turning arms 16 are supported on two hinges 17 arranged at both ends of the cooling shelf unit 1 between the blind axle 11 and the parallel front edge 8 of the goods member 2. More particularly, they are supported with a spring biasing turnably outwardly away of the goods member 4 about a turning axis 17*a* which extends parallel to the front edge of the goods member 4. When the drive motor is actuated the blind web 9 with the stabilizing rail 15 is guided downwardly along a circular arc from the upper cover part 5 to the front edge 8 of the lower goods member 2 without contacting the goods which are stacker on the cooling shelves.

In this manner, similarly to the embodiments of FIGS. 1-3, a contact of the stabilizing rail 15 and the connected blind web 9 with the good stored in the cooling space 6 of the shelf unit 1 is avoided in a simple manner.

The turning arms 16 on the hinges 17 are provided with tensioning springs. Therefore the turning arms 16 together with the weight of the stabilizing rail 15 which acts as the supporting construction for the blind web 9 is turned downwardly in direction to the movable goods member 2. As a result the stabilizing rail 15 of the blind web 9 is moved to the operational condition "blind closed" in contact with a mechanical, optical or magnetic end switch 10 in the region of the front edge 8 of the lower goods member 2 of the cooling shelf unit 1. The end switch produces corresponding signals for the motor drive of the blind arrangement as well as to a control of the cooling aggregate or to a respective signal receiver, such as for example for turning off the cooling shelf illumination or the like. In the closed condition the blind web 9 is held with tension by the lateral turning arms 16 extending parallel to one another. During the defrosting phase, the blind web 9 is moved in by the drive motor and the moist hot air can escape from the cooling chamber 6.

Figure 6:
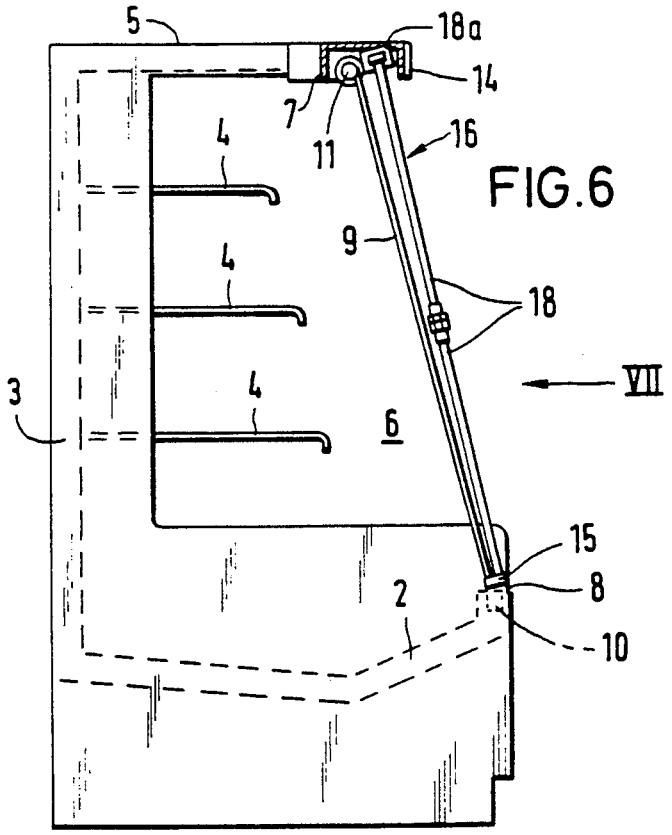
FIG. 6 is an end view of a further cooling shelf unit with a motor-driven blind web in the operational condition "blind closed"
Figure 7:
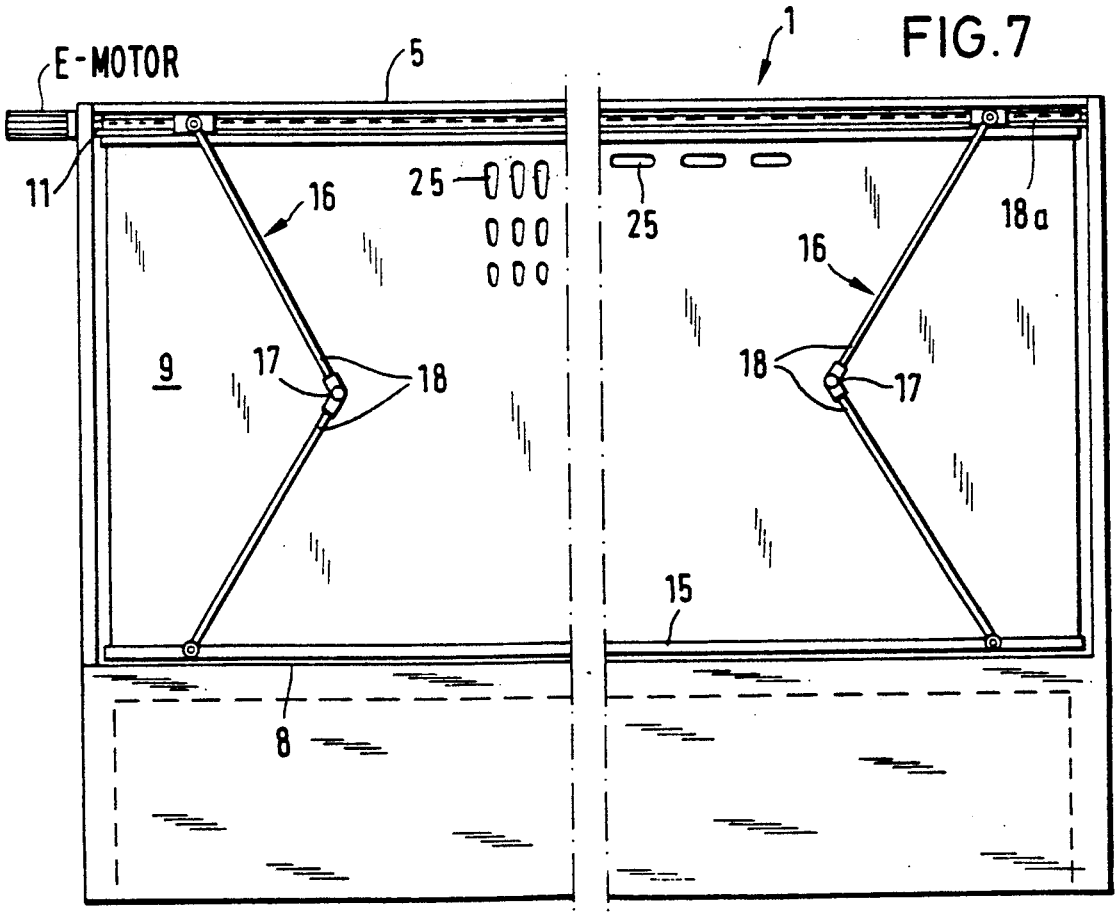
FIG. 7 is a front view of the cooling shelf unit with the blind web in a sealing direction of the arrow VII of FIG. 6.

Similarly to the embodiment of FIGS. 4 and 5, the embodiment of the heat insulating covering for cooling shelves shown in FIGS. 6 and 7 is also provided with turning arms 16 having tensioning springs. Thereby the stabilizing rail 15 with the blind web 9 running off the front edge 7 of the upper cover part 5 is moved by a motor shade element downwardly in direction to the stationary front edge 8 of the lower goods member 2.

In the embodiment of FIGS. 6 and 7 the blind web 9 with the shade axle 11 extending over the whole horizontal length of the respective cooling shelf unit 11 and the lower stabilizing rail 15 are supported on the front edge 7 of the cover part 5 under an aperture 14. Two-leg turning arms 18 arranged under a spring tension and turnable in a scissor-like manner outwardly from the shade axle 11 are located on a supporting pipe 18 and operate as turning arms 16. They have hinges 17 located between the shade axle 11 and the parallel front edge 8 of the goods member 2. Thereby the stabilizing rail 15 with the blind web 9 during rolling off from the cover part 5 to the front edge 8 of the goods member 9 moves straight downwardly and are held under tension. Due to the pretensioning in the central hinge piece of the hinge arms 18 the blind web 9 is guided to the lower edge of the cooling shelf device in a stretched condition.

In addition to the end switch for the operational condition "blind closed", in all shown embodiments the blind web 9 can be provided also with an end switch 24 shown in FIGS. 2 and 3 for the turned-in covering, or in other words for the operational condition "blind open". This end switch can be also formed as a mechanical, optical or magnetic end switch.

The blind web 9 is composed for example of at least locally or completely perforated rubberized fabric. For protecting from heat radiation, it can be provided with a heat rays reflecting layer at one side or at both sides. This will allow the escape of heat of hot, moist air from the cooling chamber 6 during the defrosting phases of the cooling aggregate, the blind web 9 can be additionally formed with slots 25 which extend horizontally or vertically and extend upwwardly. This is shown in FIG. 7. As a result the hot moist air during unfreezing of the chamber can be left under the covering in an optimal manner, without negatively influencing the goods by high temperatures.

It will be understood that each of the elements described above, or two or more together, may also find a useful application in other types of constructions differing from the types described above.

While the invention has been illustrated and described as embodied in a heat insulating covering for cooling shelves, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A heat insulating covering for a cooling shelf unit having a lower goods member, a plurality of intermediate shelf members vertically spaced from said lower goods member and from one another, and an upper cover part, the covering comprising a blind web adapted to cover a cooling space of the cooling shelf unit between a front edge of the cover part and a parallel front edge of the goods member over a whole horizontal length of the cooling shelf unit; a blind axle supporting said blind web and connected with said cooling shelf unit so as to extend over the whole horizontal length of the cooling shelf unit so that said blind web can roll onto and roll out from said blind axle; a lower stabilizing rail for tensioning said blind web; a drive motor connected with said blind axle of said blind web so as to rotate said blind axle and thereby roll said blind web both in a closing direction and in an opening direction of said blind web; spring biased turning arms supporting said stabilizing rail of said blind web and having hinges located between said blind axle and the parallel front edge of the goods member, said turning arms during rolling off of said blind web from said blind axle to the front edge of the goods member guiding said stabilizing rail with said blind web downwardly and holding said blind web under tension.

2. A heat insulating covering as defined in claim 1, wherein said two hinges being arranged at two ends of the cooling shelf unit, said turning arms engaging two ends of said stabilizing rail parallel to one another and being arranged on said hinges, so that they are turnably outwardly away of the goods member about a turning axis which extends parallel to the front edge of the goods member, said turning arms being operative to move said blind web with said stabilizing rail over a circular arc from the upper cover part to the front edge of the lower goods member without contacting goods accommodated in the cooling shelf unit.

3. A heat insulating covering as defined in claim 1, wherein said turning arms are formed as two-leg hinge arms; and further comprising a supporting pipe, said two-leg hinge arms being supported at the front edge of the cover part on said supporting pipe turnably away from said blind axle and guiding said roller web with said stabilizing rail rectilinearly downwardly in a plane between the front edge of the cove part and the front edge of the goods member.

4. A heat insulating covering as defined in claim 1, wherein said drive motor for said blind web is integrated in said blind axle.

5. A heat insulating covering as defined in claim 1; and further comprising an end switch arranged for controlling of a complete closing position of said blind web operative for supplying current to said drive motor when said blind web reaches the closing position.

6. A heat insulating covering as defined in claim 5, wherein said end switch is a mechanical end switch.

7. A heat insulating covering as defined in claim 5, wherein said end switch is an optical end switch.

8. A heat insulating covering as defined in claim 5, wherein said end switch is a magnetic end switch.

9. A heat insulating covering as defined in claim 1; and further comprising an end switch associated for said blind web and operative for controlling a movingin position of said blind web.

10. A heat insulating covering as defined in claim 9, wherein said end switch is a mechanical end switch.

11. A heat insulating covering as defined in claim 9, wherein said end switch is an optical end switch.

12. A heat insulating covering as defined in claim 9, wherein said end switch is a magnetic end switch.

13. A heat insulating covering as defined in claim 1; and further comprising supporting profiles arranged on the cover part of the cooling shelf unit transverse to its longitudinal direction and displaceable horizontally, said blind axle of said blind web being supported on said supporting profiles so that when said supporting profiles move forwardly from the cover part said blind web assumes a substantially vertical position above the front edge of the goods member for vertical rolling off to the front edge of the goods member.

14. A heat insulating covering as defined in claim 13; and further comprising a motor-driven toothed rack drive including toothed gears, said supporting profiles for said blind axle being formed as toothed racks engaging said toothed gears.

15. A heat insulating covering as defined in claim 13; and further comprising a cover element arranged to cover an intermediate space between said supporting profiles over a whole horizontal length of the cooling shelf unit.

16. A heat insulating covering as defined in claim 15, wherein said cover element is formed as a fabric element.

17. A heat insulating covering as defined in claim 15, wherein said cover element is formed as a metal sheet element.

* * * * *